US005766692A

United States Patent [19]

Lee et al.

[11] Patent Number: 5,766,692

[45] Date of Patent: Jun. 16, 1998

[54] PROCESS FOR DEPOSITING OXYNITRIDE FILM ON SUBSTRATE BY LIQUID PHASE DEPOSITION

[75] Inventors: Ming-Kwei Lee, Kaohsiung; Chung-Hsing Lin, Pingtung Hsien, both of Taiwan

[73] Assignee: National Science Council, Taipei, Taiwan

[21] Appl. No.: 819,017

[22] Filed: Mar. 17, 1997

[30] Foreign Application Priority Data

Jan. 30, 1997 [TW] Taiwan ..... 86101045

[51] Int. Cl.[6] ..... B05D 1/18

[52] U.S. Cl. ..... 427/443.2; 427/430.1; 427/397.7; 427/377; 438/786

[58] Field of Search ..... 427/226, 430.1, 427/443.2, 377, 397.7; 438/786

[56] References Cited

U.S. PATENT DOCUMENTS 5,565,376 10/1996 Lur et al. ..... 437/67

OTHER PUBLICATIONS

Yeh et al. Appl. Phys. Lett. 66(8), Feb. 1995, pp. 938–940.

*Primary Examiner*—Roy V. King
*Attorney, Agent, or Firm*—Townsend and Townsend and Crew LLP

[57] ABSTRACT

A process for depositing an oxynitride film on a substrate by liquid phase deposition. A nitrogen radical-containing solution is added to a silicon dioxide supersaturated solution to obtain a deposition solution. Then, a substrate is contacted with the deposition solution to deposit the oxynitride film on the substrate, followed by thermal annealing under nitrogen.

11 Claims, 5 Drawing Sheets

(a)

(b)

PROCESS FOR DEPOSITING OXYNITRIDE FILM ON SUBSTRATE BY LIQUID PHASE DEPOSITION

BACKGROUND OF THE INVENTION

1. Field of the Invention

The present invention relates to a process for depositing an oxynitride (SiON) film on a substrate by liquid phase deposition (LPD), and more particularly to a process for depositing an oxynitride film using silicon dioxide LPD process together with a nitrogen radical-containing solution.

2. Description of the Prior Art

Metal ions (such as sodium and potassium ions) do not easily migrate through an oxynitride film due to the higher density of oxynitride. Therefore, to protect a substrate from being attacked by metal ions, an oxynitride film is often deposited on a substrate by vapor deposition. Such a vapor deposition process involves reacting silicon hydride ($SiH_4$), nitrous oxide ($N_2O$) and ammonia ($NH_3$) in a high temperature of about 1000° C.–1200° C. It has the disadvantages of high equipment cost, and generation of undesirable stress due to high temperature process.

In recent years, depositing silicon dioxide films by liquid phase deposition (LPD) has been developed and has drawn many researchers' attention since the deposition can be employed at lower temperature (room temperature). However, the grown silicon dioxide film cannot effectively prevent metal ion attacking.

SUMMARY OF THE INVENTION

Therefore, there is a need to develop a new deposition process, in which the film can be deposited at low temperatures and the deposited film can effectively prevent metal ion attacking.

To attain the above-mentioned object, the present invention combines the advantages of silicon dioxide and oxynitride and deposit oxynitride films using the technique of silicon dioxide LPD together with a nitrogen radical-containing solution.

According to the present invention, the process for depositing an oxynitride film on a substrate by liquid phase deposition includes:

(a) providing a silicon dioxide supersaturated solution;

(b) adding a nitrogen radical-containing solution to the silicon dioxide supersaturated solution to obtain a deposition solution; and (c) contacting a substrate with the deposition solution obtained from step (b) to deposit an oxynitride film on the substrate.

DETAILED DESCRIPTION OF THE INVENTION

According to the present invention, a silicon dioxide supersaturated solution is first provided. All the silicon dioxide supersaturated solutions suitable for use as the treatment solution for depositing a silicon dioxide film by LPD are also suitable for use in the present invention. For example, the silicon dioxide supersaturated solution can be a hydrofluorosilicic acid ($H_2SiF_6$) solution supersaturated with silicon dioxide.

Then, to deposit an oxynitride film, a nitrogen radical-containing solution should be mixed with the silicon dioxide supersaturated solution to obtain a deposition solution. Finally, a substrate is contacted with the deposition solution; thus the oxynitride film can be grown on the substrate.

The oxynitride film of the present invention can be deposited at an ordinary temperature for depositing films by LPD, which is close to room temperature, and preferably at 25° C.–50° C.

The nitrogen radical-containing solution of the present invention is used for providing the nitrogen source for depositing oxynitride films. Suitable nitrogen radical-containing solutions can be, for example ammonia water (ammonium hydroxide), nitric acid, a mixed solution of nitric acid and ammonia water, or an ammonium nitrate solution.

To make the oxynitride film form a denser Si—N bond, the oxynitride film deposited by the above-mentioned deposition solution (a mixture of the silicon dioxide supersaturated solution and the nitrogen radical-containing solution) is further subjected to thermal annealing under nitrogen at 600° C. to 1000° C.

The following examples serve to demonstrate the features and advantages of the present invention, yet are not intended to be limiting since numerous modifications and variations will be apparent to those skilled in the art.

EXAMPLE 1

21 g of high purity (99.99%) silica-gel was dissolved in 450 mL (4 mol/L) of hydrofluorosilicic acid aqueous solution and was stirred for 17 hours at about 23° C. The resultant solution was filtered to remove undissolved silica-gel. 32 mL of the solution (4 mol/L) was diluted with deionized water to be 3.56 mol/L. Thus, the treatment solution (the hydrofluorosilicic acid solution supersaturated with silicon dioxide) was prepared.

Ammonia water (0.064 mol/L) was added into the treatment solution to obtain the deposition solution. Subsequently, a silicon wafer was immersed in the deposition solution at 40° C. for LPD-SiON film deposition. Finally, the SiON deposited silicon wafer was subjected to thermal annealing under nitrogen at 600° C., 750° C., and 900° C., respectively.

Figure 1:
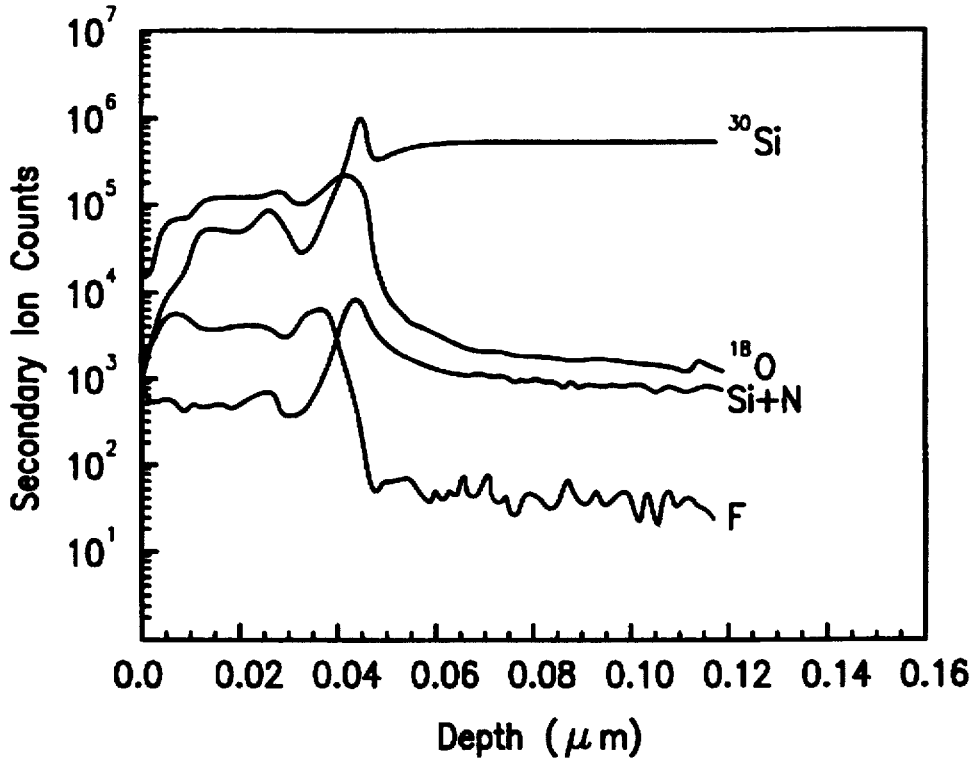
FIGS. 1(*a*) and 1(*b*) show the SIMS profile of an oxynitride film grown by LPD (a) before thermal annealing under nitrogen and (b) after 90 minutes of thermal annealing under nitrogen at 900° C.
Figure 1:
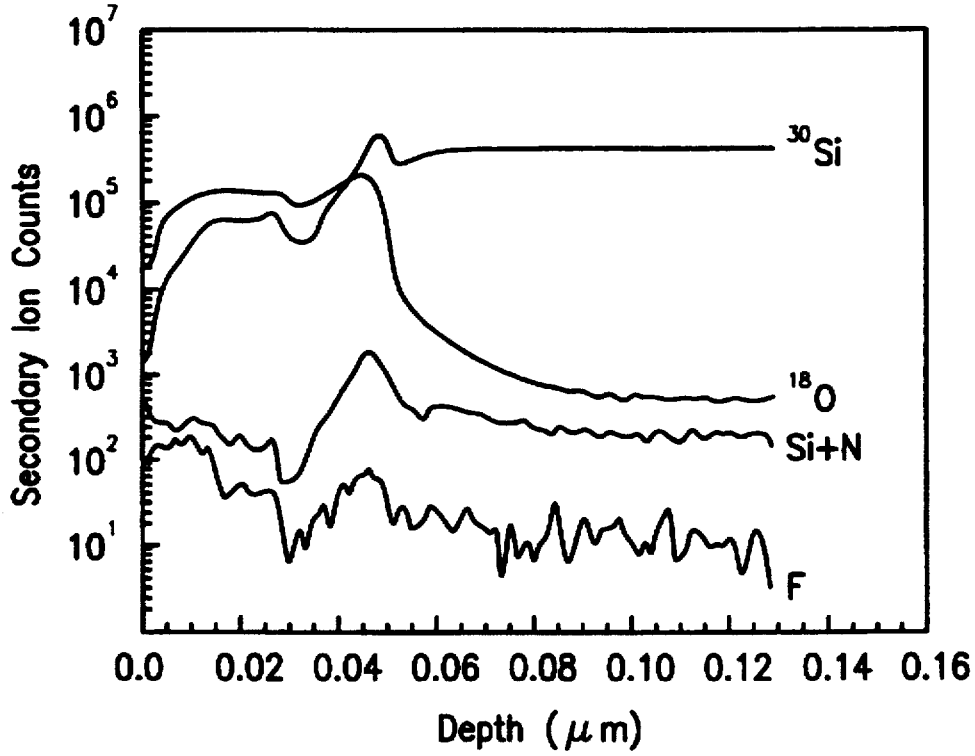

The obtained SiON films were analyzed by secondary ion mass spectroscopy (SIMS). FIGS. 1(*a*) and 1(*b*) show the SIMS profile of an oxynitride film by LPD (a) before thermal annealing under nitrogen and (b) after 90 minutes of thermal annealing under nitrogen at 900° C. It can be seen that nitrogen has entered the film after the deposition, and the nitrogen content does not decrease after thermal annealing.

Figure 2:
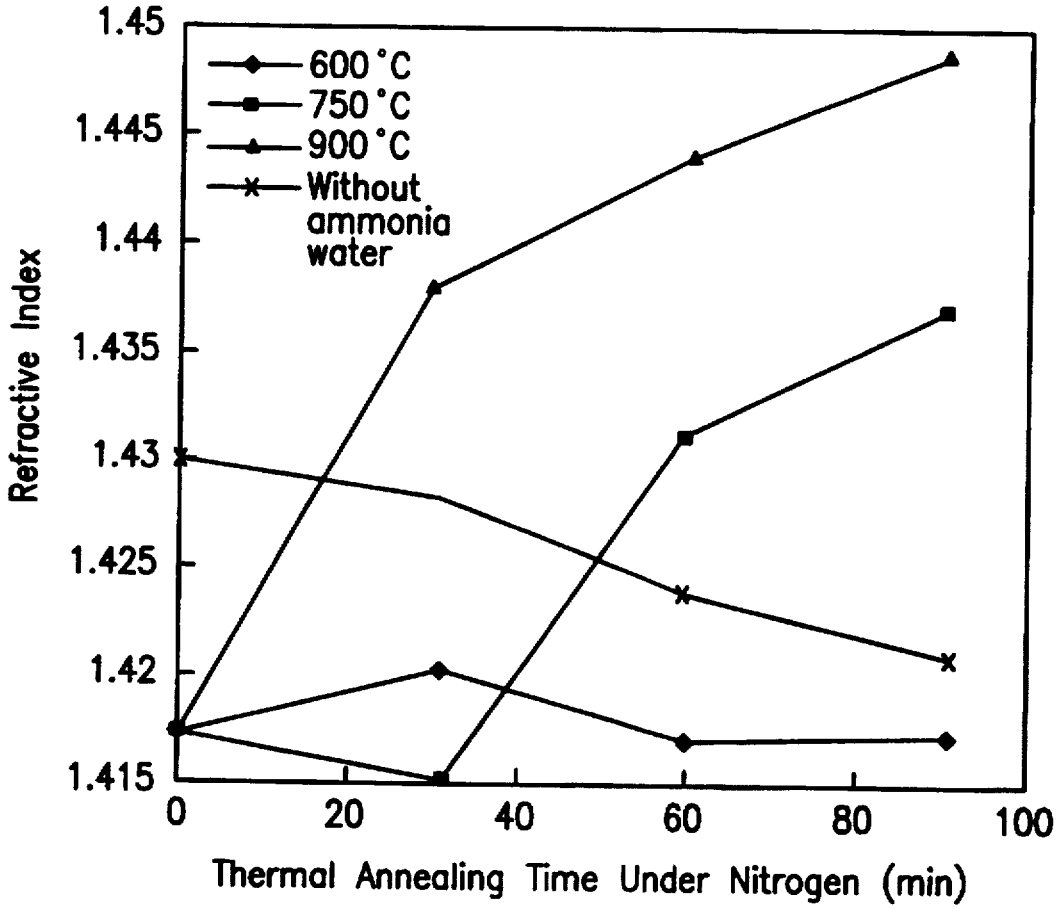
FIG. 2 shows the refractive index of the obtained oxynitride film as a function of the thermal annealing time under nitrogen.

FIG. 2 shows the refractive index of the obtained oxynitride film as a function of the thermal annealing time under nitrogen. Further, the refractive index of the SiON film deposited by the treatment solution (without ammonia water) and annealed under nitrogen at 700° C. was also analyzed. It can be seen that after thermal annealing, the SiON film has a higher refractive index. The SiON film deposited by the treatment solution without ammonia water has a lower refractive index than that deposited by the deposition solution with ammonia water. The maximum refractive index shown in the figure is 1.449.

Figure 3:
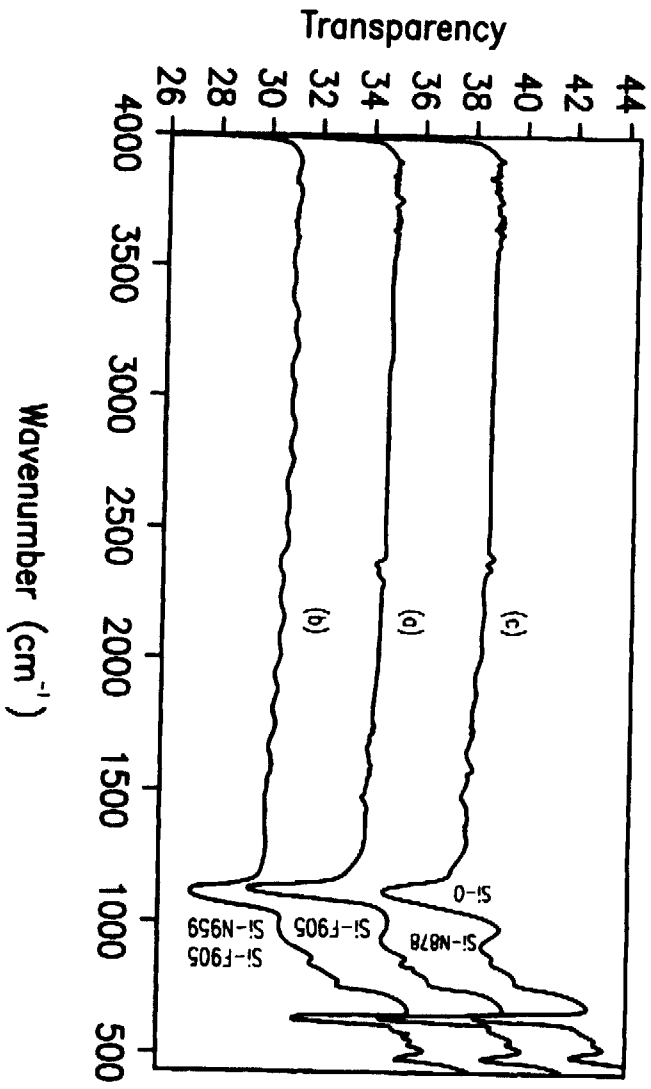
FIGS. 3(*a*)–3(*c*) show the FTIR absorption spectra of the oxynitride film (a) before thermal annealing under nitrogen, (b) after thermal annealing under nitrogen at 750° C. for 60 minutes, and (c) after thermal annealing under nitrogen at 900° C. for 90 minutes.

FIG. 3 shows the FTIR absorption spectra of the oxynitride film (a) before thermal annealing under nitrogen, (b) after thermal annealing under nitrogen at 750° C. for 60 minutes, and (c) after thermal annealing under nitrogen at 900° C. for 90 minutes. It can be seen that thermal annealing under nitrogen results in a much denser Si—N bond.

Figure 4:
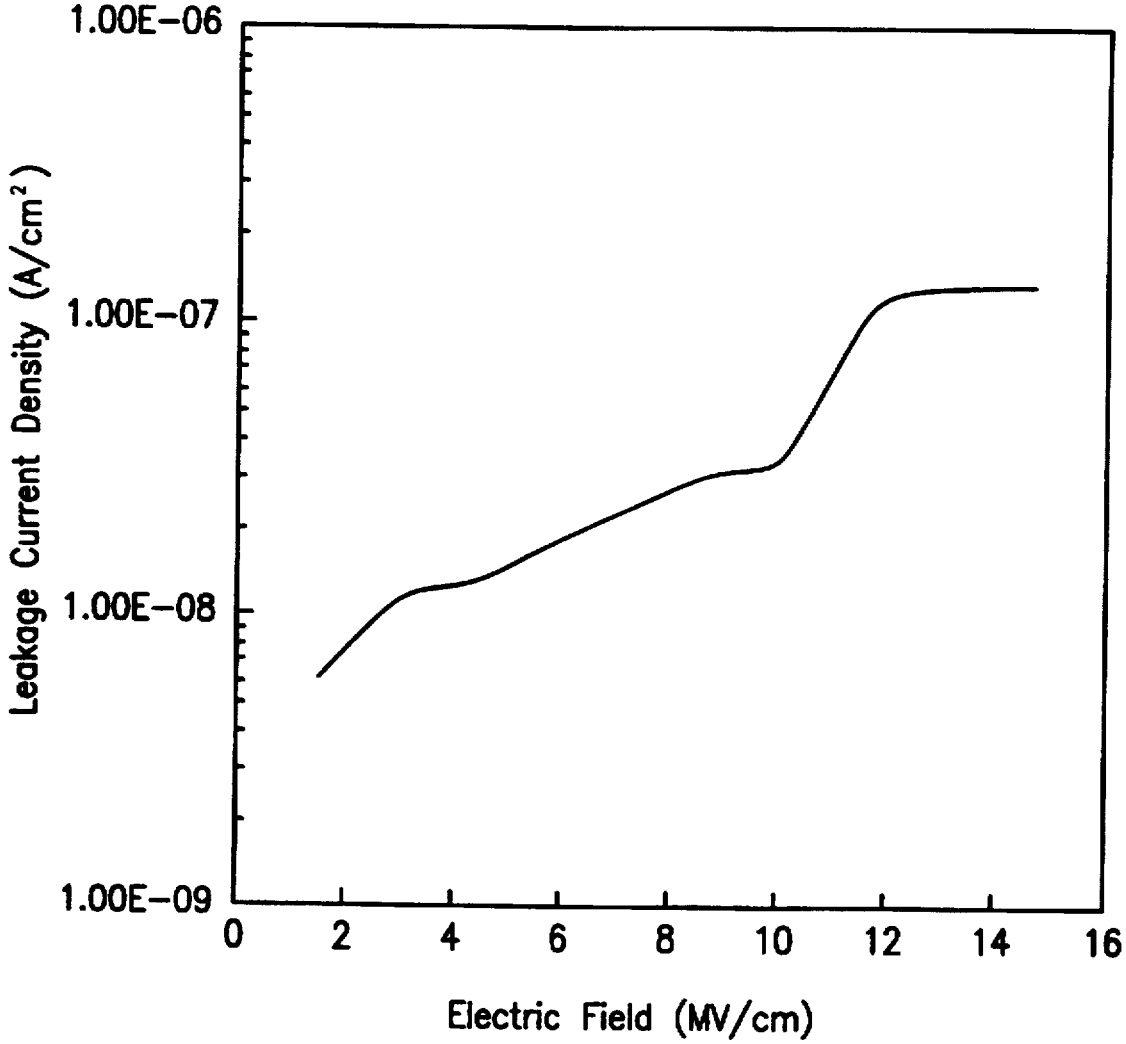
FIG. 4 shows the leakage current density versus electric field of the LPD deposited oxynitride film.

FIG. 4 shows the leakage current density versus electric field of the LPD deposited oxynitride film. It can be seen that by employing the process for depositing the SiON film, not only can the resultant SiON film act as a barrier to metal ions, but also the leakage current is lowered and the breakdown voltage is increased (higher than $10^7$ V/cm), indicating that the electrical properties of the film are improved.

Figure 5:
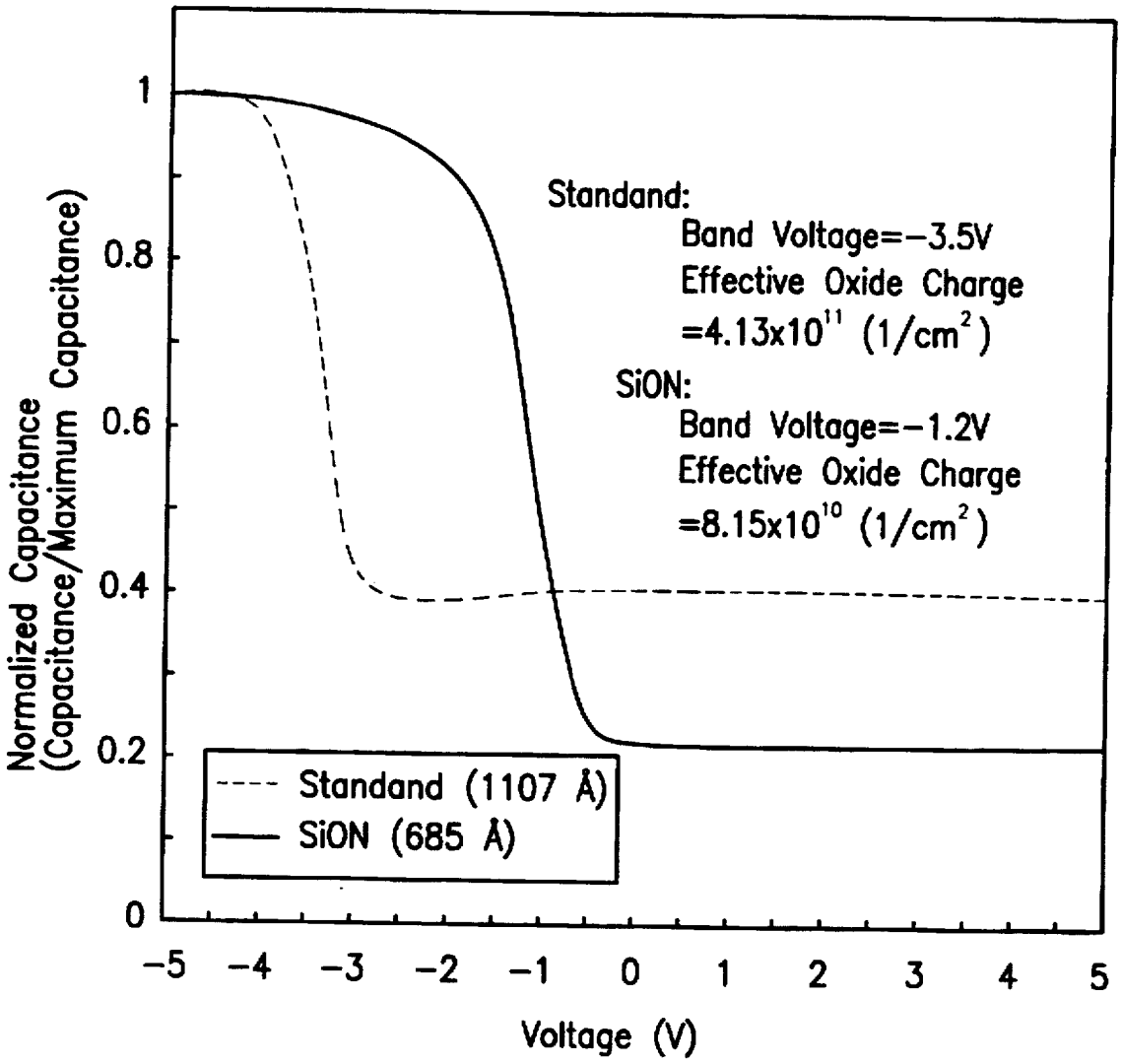
FIG. 5 shows the capacitance versus voltage curve of the LPD deposited oxynitride film.

FIG. 5 shows the capacitance versus voltage curve of the LPD deposited oxynitride film. It can be seen that the effective charges contained in the film have decreased to $8.15\times10^{10}$ $cm^{-2}$, and the interface trap charges have also decreased, indicating that the electrical properties of the SiON film have been improved.

EXAMPLE 2

The same procedures as described in Example 1 were employed, except that the nitrogen radical-containing solution used was an ammonium nitrate aqueous solution (0.59 mol/L). The SiON film treated by thermal annealing under nitrogen had a refractive index about 1.5 to 1.8.

EXAMPLE 3

The same procedures as described in Example 1 were employed, except that the nitrogen radical-containing solution used was a mixed solution of nitric acid (1.05 mol/L) and ammonia water (0.49 mol/L) . The SION film obtained before thermal annealing under nitrogen had a refractive index about 1.7 to 1.9, and the SiON film obtained after thermal annealing had a higher refractive index about 1.9 to 2.0.

Summing up, the present invention utilizes the silicon dioxide LPD deposition and a nitrogen radical-containing solution to deposit a SiON film. Not only can the obtained SiON film act as a good barrier to metal ions, but also the electrical properties of the film are improved. For instance, the leakage current is reduced, the breakdown voltage is raised, and the interface trap charges are reduced.

What is claimed is:

1. A process for depositing an oxynitride film on a substrate by liquid phase deposition, including the following steps of:

(a) providing a silicon dioxide supersaturated solution;

(b) adding a nitrogen radical-containing solution to the silicon dioxide supersaturated solution to obtain a deposition solution; and (c) contacting the substrate with the deposition solution obtained from step (b) to deposit the oxynitride film on the substrate.

2. The process as claimed in claim 1, further comprising thermal annealing the oxynitride film-deposited substrate obtained from step (c) under nitrogen at 600° C. to 1000° C.

3. The process as claimed in claim 1, wherein the nitrogen radical-containing solution is selected from the group consisting of ammonia water, nitric acid, a mixed solution of nitric acid and ammonia water, and an ammonium nitrate solution.

4. The process as claimed in claim 3, wherein the nitrogen radical-containing solution is ammonia water.

5. The process as claimed in claim 3, wherein the nitrogen radical-containing solution is nitric acid.

6. The process as claimed in claim 3, wherein the nitrogen radical-containing solution is a mixed solution of nitric acid and ammonia water.

7. The process as claimed in claim 3, wherein the nitrogen radical-containing solution is an ammonium nitrate solution.

8. The process as claimed in claim 1, wherein the silicon dioxide supersaturated solution is a hydrofluorosilicic acid solution supersaturated with silicon dioxide.

9. The process as claimed in claim 1, wherein in step (c) the oxynitride film is deposited on the substrate at a temperature of 25° C. to 50° C.

10. The process as claimed in claim 9, wherein in step (c) the oxynitride film is deposited on the substrate at 40° C.

11. The process as claimed in claim 2, wherein the thermal annealing under nitrogen is conducted at 900° C.

* * * * *